US010551034B1

(12) United States Patent
Belliveau

(10) Patent No.: US 10,551,034 B1
(45) Date of Patent: Feb. 4, 2020

(54) MULTICELL THEATRICAL LIGHT INCORPORATING A PLURALITY OF DIFFUSE AUREOLES

(71) Applicant: Richard S. Belliveau, Austin, TX (US)

(72) Inventor: Richard S. Belliveau, Austin, TX (US)

( * ) Notice: Subject to any disclaimer, the term of this patent is extended or adjusted under 35 U.S.C. 154(b) by 0 days.

(21) Appl. No.: 16/413,419

(22) Filed: May 15, 2019

(51) Int. Cl.

| | |
|---|---|
| ***F21V 13/02*** | (2006.01) |
| ***F21V 21/30*** | (2006.01) |
| ***F21V 5/00*** | (2018.01) |
| ***F21V 5/04*** | (2006.01) |
| *F21Y 113/13* | (2016.01) |
| *F21W 131/406* | (2006.01) |
| *F21Y 115/10* | (2016.01) |
| *F21Y 115/30* | (2016.01) |

(52) U.S. Cl.
CPC ..... *F21V 13/02* (2013.01); *F21V 5/007* (2013.01); *F21V 5/04* (2013.01); *F21V 21/30* (2013.01); *F21W 2131/406* (2013.01); *F21Y 2113/13* (2016.08); *F21Y 2115/10* (2016.08); *F21Y 2115/30* (2016.08)

(58) Field of Classification Search
CPC . F21V 13/02; F21V 5/007; F21V 5/05; F21V 21/30
See application file for complete search history.

(56) References Cited

U.S. PATENT DOCUMENTS

| | | | | |
|---|---|---|---|---|
| 6,940,654 | B1 * | 9/2005 | Tang | G02B 3/0012 257/233 |
| RE40,015 | E | 1/2008 | Belliveau | |
| D700,385 | S | 2/2014 | Quadri | |
| RE44,903 | E | 5/2014 | Belliveau | |
| 8,801,225 | B2 | 8/2014 | Dalsgaard | |
| 9,664,909 | B1 * | 5/2017 | Whiteside | G02B 27/141 |
| 9,781,779 | B2 | 10/2017 | Vinther et al. | |
| D819,258 | S | 5/2018 | Jurik et al. | |
| 10,162,105 | B2 | 12/2018 | Jurik et al. | |
| 2011/0083460 | A1 * | 4/2011 | Thomas | A47F 3/001 62/264 |

(Continued)

FOREIGN PATENT DOCUMENTS

| | | |
|---|---|---|
| EP | 0961136 A2 | 12/1990 |

OTHER PUBLICATIONS https://www.highend.com/documentation/SolaWash%2037/SWash%2037-19%20TDS%207-5-17.pdf.
https://www.claypaky.it/en/products/HY_B-EYE_K15.
https://germanlightproducts.com/products/glp/moving-head/impression-x4-copy/.

*Primary Examiner* — Anne M Hines
(74) *Attorney, Agent, or Firm* — Walter J. Tencza, Jr.

(57) ABSTRACT

A theatre lighting apparatus including a base housing; and a lamp housing; wherein the lamp housing is remotely positioned in relation to the base housing by a motor; and wherein the lamp housing is comprised of a plurality of light sources and a plurality of lenses. Each of the plurality of lenses has a first surface and a second surface; each second surface of each of the plurality of lenses has an inner portion and a perimeter portion; and wherein the inner portion of each of the plurality of lenses is substantially more polished, and substantially less diffuse that the corresponding perimeter portion of each of the plurality of lenses so that light is transmitted in a substantially uniform direction through the inner portion of each of the plurality of lenses and light is transmitted in a scattered manner through the perimeter portion of each of the plurality of lenses.

14 Claims, 6 Drawing Sheets

(56) References Cited

U.S. PATENT DOCUMENTS

| | | | | |
|---|---|---|---|---|
| 2013/0021796 | A1 | 1/2013 | Dalsgaard | |
| 2013/0301256 | A1* | 11/2013 | Thomas | F21V 21/00 362/224 |
| 2015/0247614 | A1 | 9/2015 | Belliveau | |
| 2016/0290597 | A1 | 10/2016 | Jurik et al. | |
| 2019/0041027 | A1 | 2/2019 | Belliveau | |

* cited by examiner

MULTICELL THEATRICAL LIGHT INCORPORATING A PLURALITY OF DIFFUSE AUREOLES

FIELD OF THE INVENTION

This invention relates to multiparameter lighting fixtures.

BACKGROUND OF THE INVENTION

Multiparameter theatre lighting fixtures are lighting fixtures, which illustratively have two or more individually remotely adjustable parameters such as focus, color, image, position, or other light characteristics. Multiparameter lighting fixtures are widely used in the lighting industry because they facilitate significant reductions in overall lighting system size and permit dynamic changes to the final lighting effect. Applications and events in which multiparameter lighting fixtures are used to great advantage include showrooms, television lighting, stage lighting, architectural lighting, live concerts, and theme parks.

Multiparameter theatre lighting fixtures are commonly constructed with a lamp housing that may pan and tilt in relation to a base housing so that light projected from the lamp housing can be remotely positioned to project on a stage surface. Commonly a plurality of multiparameter lights are controlled by an operator from a central controller. The central controller is connected to communicate with the plurality of multiparameter lights via a communication system.

Present day light sources for theatrical instruments are primarily comprised of light emitting diodes (LEDs). U.S. Pat. No. RE44,903 to Belliveau discloses a device that uses a plurality of light sources. The light sources may be light emitting diodes (LEDs). U.S. Design Pat. No. D70038551 to Quadri illustrates a theatrical light with which incorporates a plurality of light sources. While prior art theatrical lights incorporating a plurality of light sources are effective for the purpose of projecting light on a stage, the manufacture of theatrical lights incorporating a plurality of light sources is competitive. Manufacturers strive to incorporate special effects or features into the theatrical lights.

One type of special effect incorporated into a theatrical light comprising a plurality of light sources is described in U.S. Pat. No. RE40,015 to Belliveau which discloses a lighting device with beam altering mechanism incorporating a plurality of light sources. An aperture device comprising a plurality of colors or light refracting optics can be rotated to provide a visual effect. One such manufactured theatrical lighting product practicing the art is the "Clay Paky Bee Eye" (trademarked) as seen at https://www.claypaky.it/en/products/aleda-b-eye-k10 which discloses that "... the front lens may be rotated to create lots of small bright compositions, which may be opened and closed like petals ...."

U.S. Pat. No. 9,781,779 to Vinther describes a first group of light sources 203 which have light collectors 209 such as internal reflection (TIR) lenses, mixers or other lenses placed over them to collect and convert light of the light sources into a number of light source beams. A second group of light sources 205 pass light through diffusing areas 215 of a diffuser 213 in the form of a diffusion cover included in the lamp housing to diffuse the light and create a background light for the first group of light sources 203. The light from the first group of light sources 203 passes through non diffusing regions 211 of the diffuser cover without the light being diffused. The second group of light sources 205 are interleaved with the first group 203 by the diffuser having one or several diffusion areas between non diffusion areas. By controlling both groups of light sources based on the same target color the dotted look of led light sources can be removed or by controlling the two groups of light sources based on two different colors light effects can be obtained.

U.S. Pat. No. 10,162,105 to Jurik describes an automated luminaire which includes a light engine having a multi-color LED array light source, a light guide which incompletely homogenizes such that colored light beams visibly retain separation and individual color, and a zoom lens system that projects the incompletely homogenized light beams in a spreading pattern that opens and closes as lenses are moved toward and away from the light guide.

SUMMARY OF THE INVENTION

In at least one embodiment of the present invention a theatre lighting apparatus is provided comprising: a base housing; and a lamp housing; wherein the lamp housing is remotely positioned in relation to the base housing by a motor; and wherein the lamp housing is comprised of a plurality of light sources and a plurality of lenses.

In at least one embodiment, each of the plurality of lenses has a first surface and a second surface; each second surface of each of the plurality of lenses has an inner portion and a perimeter portion; and wherein the inner portion of each of the plurality of lenses is substantially more polished, and substantially less diffuse that the corresponding perimeter portion of each of the plurality of lenses so that light is transmitted in a substantially uniform direction through the inner portion of each of the plurality of lenses and light is transmitted in a scattered manner through the perimeter portion of each of the plurality of lenses.

In at least one embodiment, at least one of the plurality of lenses is octagonally shaped. The perimeter portions of each of the plurality of lenses may have a surface area which is between five and fifteen percent of the overall surface area of the corresponding lens of each of the plurality of lenses.

Each of the plurality of light sources may be comprised of a light emitting diode. Each of the plurality of light sources may be a laser diode. Each of the plurality of light sources may be comprised of a red, blue and green LED. Each of the plurality of lenses may be aspherical shaped.

In at least one embodiment a method is provided which includes creating a plurality of aureoles on a plurality of lenses as part of a theatre lighting apparatus; wherein the theatre lighting apparatus may be as previously described and may be comprised of: a base housing; and a lamp housing; wherein the lamp housing is remotely positioned in relation to the base housing by a motor; and wherein the lamp housing is comprised of a plurality of light sources and the plurality of lenses.

Each of the plurality of lenses may have a first surface and a second surface; wherein each second surface of each of the plurality of lenses has an inner portion and a perimeter portion; and wherein the inner portion of each of the plurality of lenses is substantially more polished, and substantially less diffuse that the corresponding perimeter portion of each of the plurality of lenses so that light is transmitted in a substantially uniform direction through the inner portion of each of the plurality of lenses and light is transmitted in a scattered manner through the perimeter portion of each of the plurality of lenses.

DETAILED DESCRIPTION OF THE DRAWINGS

Figure 1:
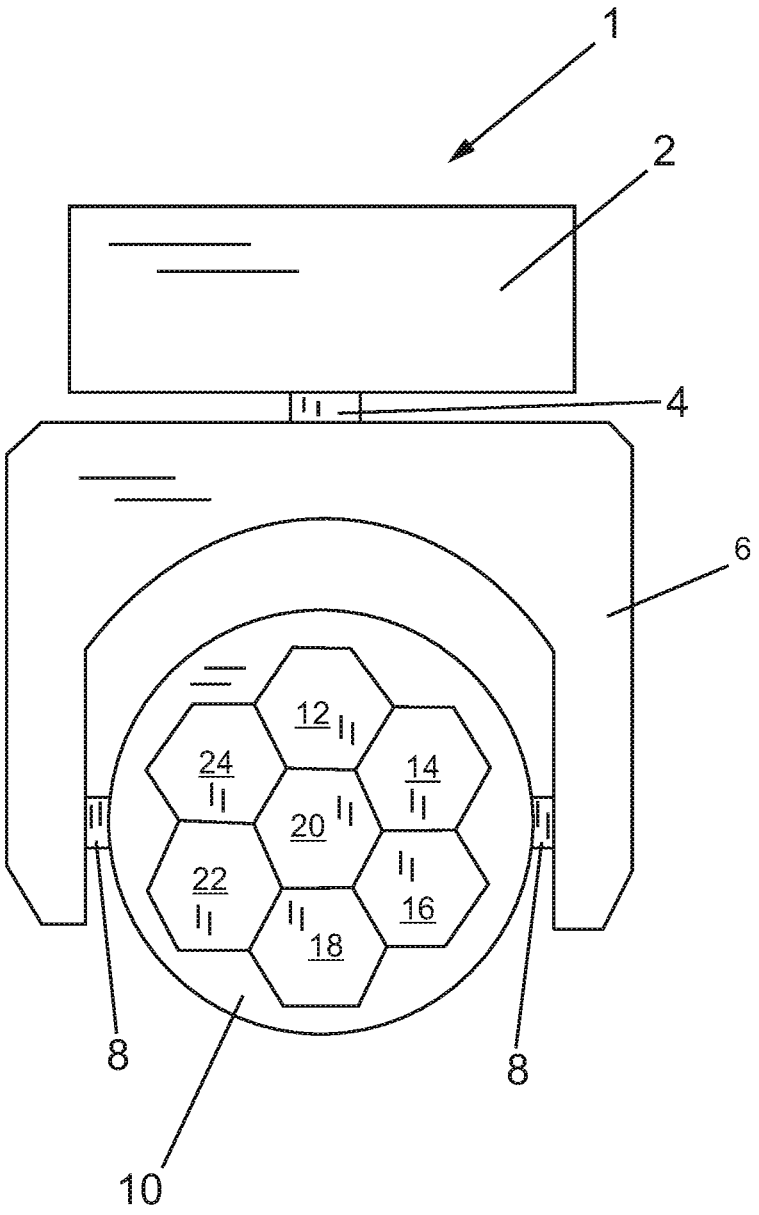
Fig. 1 (Prior Art)
FIG. 1 shows a prior art theatrical light incorporating a plurality of light sources.

FIG. 1 shows a prior art theatrical light 1 incorporating a plurality of light sources, not shown. A base housing 2 is rotatably attached to a yoke 6 via pan shaft 4. The yoke 6 is rotatably attached to the lamp housing 10 via tilt shafts 8 and 8. Base housing 2 is positioned in relation to yoke 6 by a motor not shown for simplification. Yoke 6 is positioned in relation to lamp housing 10 by a motor not shown for simplification. Shown in the lamp housing 10 are seven lenses 12, 14, 16, 18, 20, 22, and 24. In at least one embodiment, each of the lenses 12, 14, 16, 18, 20, 22, and 24 has a hexagonal shape in order to achieve a high density arrangement. Each of the lenses 12, 14, 16, 18, 20, 22, and 24 of the prior art are commonly a plano convex lens or preferably an aspherical shape that allows for spherical aberration correction as known in the art. Each of the lenses 12, 14, 16, 18, 20, 22, and 24, are commonly acrylic or glass with a polished surface to allow high transmission. The surface of each of the lenses 12, 14, 16, 18, 20, 22, and 24 can be manually polished or the polish may be a function of an injection mold that provides a polished surface to each lens to achieve high transmission and contrast.

Figure 2:
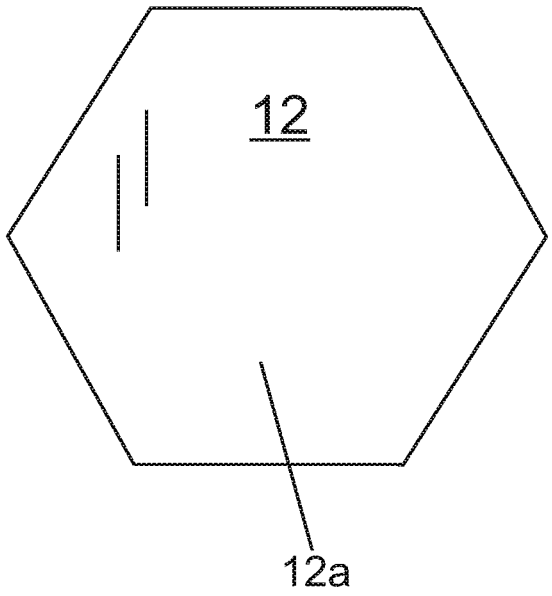
Fig. 2 (Prior Art)
FIG. 2 shows a single prior art lens with a polished surface.

FIG. 2 shows a prior art lens 12 in a hexagonal shape with a polished top surface 12*a*.

Figure 3:
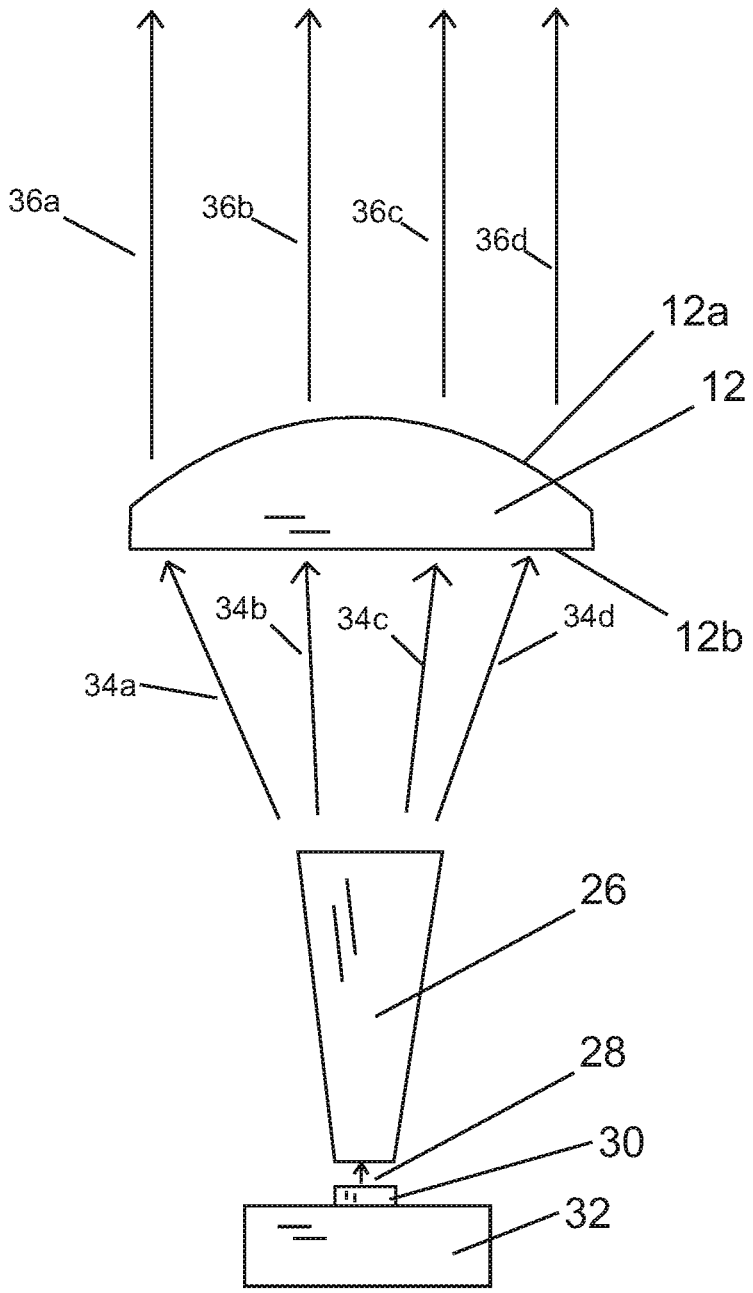
Fig. 3 (Prior Art)
FIG. 3 shows a single multicolor light source, light pipe and prior art lens.

FIG. 3 shows a side view of the lens 12 of FIG. 2 and the light source 32 that may be a multicolor light source comprising Red, Green, Blue and White light emitting diodes. An emission lens 30 emits the multiwavelength light in the direction of arrow 28 to a light pipe 26. The use of the light pipe 26 helps to blend or homogenize the multicolor light from the multicolor light sources 32 The light pipe 26 in turn emits the homogenized light in the direction of a bottom polished surface 12*b* of the lens 12, such as in the directions or arrows 34*a*, 34*b*, 34*c*, and 34*d*. The focused light (shown by rays 36*a*, 36*b*, 36*c*, and 36*d* passes thought the lens 12 in the direction of rays 36*a-d*. While FIG. 3 shows only one light source 32 of the plurality of light sources of the prior art theatrical light 1 the other six light sources, corresponding and used for the other lenses 14, 16, 18, 20, and 22, may be identical in construction to light source 32.

Figure 4:
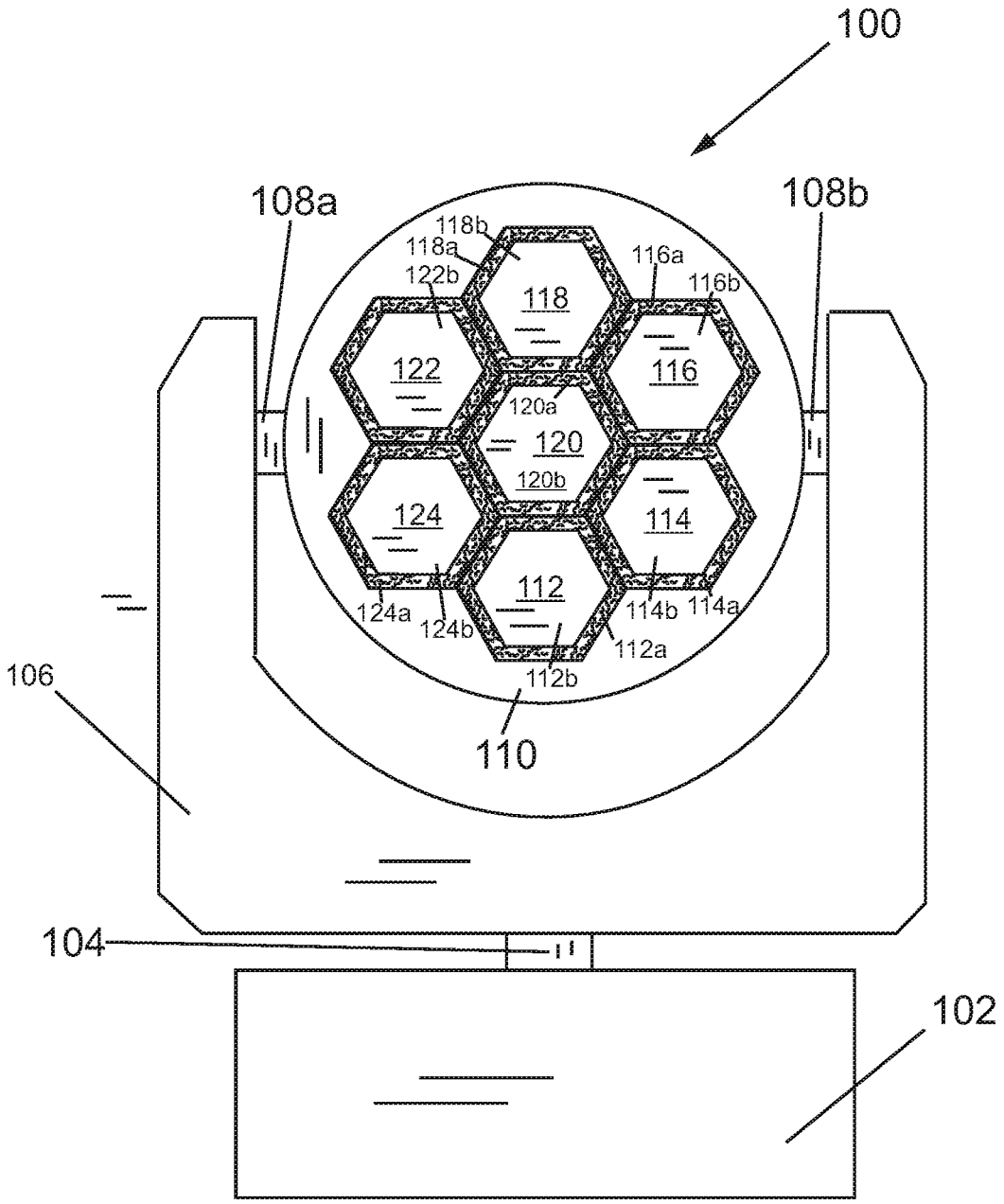
FIG. 4 shows a theatrical light of the invention.

FIG. 4 shows a theatrical light 100 in accordance with an embodiment of the present invention. A base housing 102 is rotatably attached to a yoke 106 via pan shaft 104. The yoke 106 is rotatably attached to the lamp housing 110 via tilt shafts 108*a* and 108*b*.

Base housing 102 is positioned in relation to yoke 106 by a motor not shown for simplification. Yoke 106 is positions in relation to lamp housing 110 by a motor not shown for simplification. Shown in and/or attached to the lamp housing 110 are seven lenses of at least one embodiment of the present invention, which includes lenses 112, 114, 116, 118, 120, 122, and 124. Each lens of lenses 112, 114, 116, 118, 120, 122, and 124 may be identical to each other lens of lenses 112, 114, 116, 118, 120, 122, and 124. Each of the lenses 112, 114, 116, 118, 120, 122, and 124 has, in at least one embodiment, a hexagonal shape in order to achieve a high density arrangement. Each of the lenses 112, 114, 116, 118 120, 122, and 124 may be a plano convex lens or preferably an aspherical shape that allows for spherical aberration correction as known in the art. Each of the lenses may be acrylic or glass with polished surfaces, such as 112*b* and 112*c* for lens 112 and similar or identical surfaces for similar or identical lenses 114, 116, 118, 120, 122, and 124. The surface of the inner or central area or region 112*b* or the surface 112*c* shown in FIG. 5, in at least one embodiment, may have a manually polished or the polish may be a function of an injection mold that provides a polished surface in the areas of surfaces 112*b* and 112*c* of the lens 112 to achieve high transmission and contrast. A description of a polished surface for a lens can be seen at https://www.swiftglass.com/blog/understanding-optical-glass-surface-specifications/where a substantially polished surface can be considered 50 (fifty) Å (angstroms) RMS (root mean square roughness average). The lenses 112, 114, 116, 118, 120, 122, and 124 have corresponding perimeters or perimeter areas 112*a*, 114*a*, 116*a*, 118*a*, 120*a*, 122*a*, and 124*a* and corresponding inner or central areas 112*b*, 114*b*, 116*b*, 118*b*, 120*b*, 122*b*, and 124*b*. The inner or central areas 112*b*-124*b* typically have polished top and bottom outer surfaces.

Figure 5:
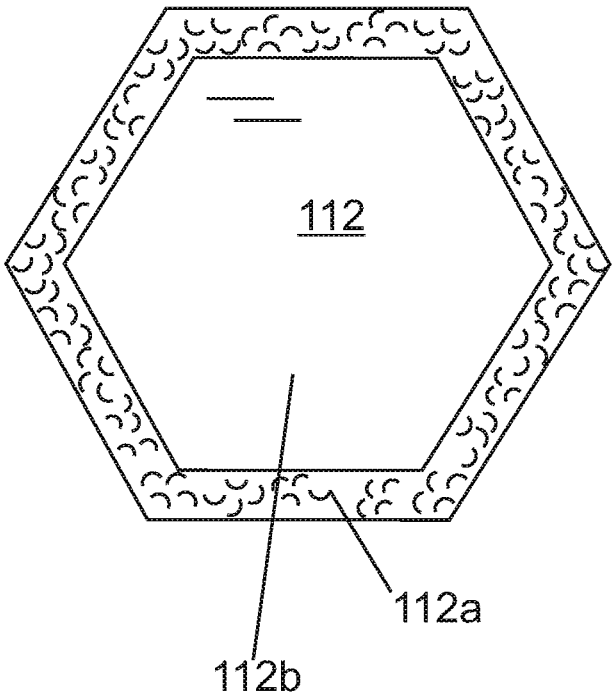
FIG. 5 shows a single lens of the invention.

The perimeters 112*a*-124*a* of the seven lenses 112, 114, 116, 118, 120, 122, and 124 as shown by FIGS. 4-5 have been made substantially diffuse. It is preferred the diffuse area 112*a* of lens 112 has been arranged to mimic the hexagonal shape of the outer perimeter of the lens 112. The lens 112 may not be a hexagonal lens for example it may be a round or a square lens. The diffuse area may or may not mimic the other perimeter of the lens, but it is preferred, in at least one embodiment, that the diffuse area mimic the perimeter of the lens to provide a pleasing visual effect in at least one embodiment.

The diffuse areas, such as 112*a*-124*a* may be created by roughing the surface of the corresponding lenses of 112-124 to an unpolished state, bead blasting, acid etching or texturing.

Figure 6:
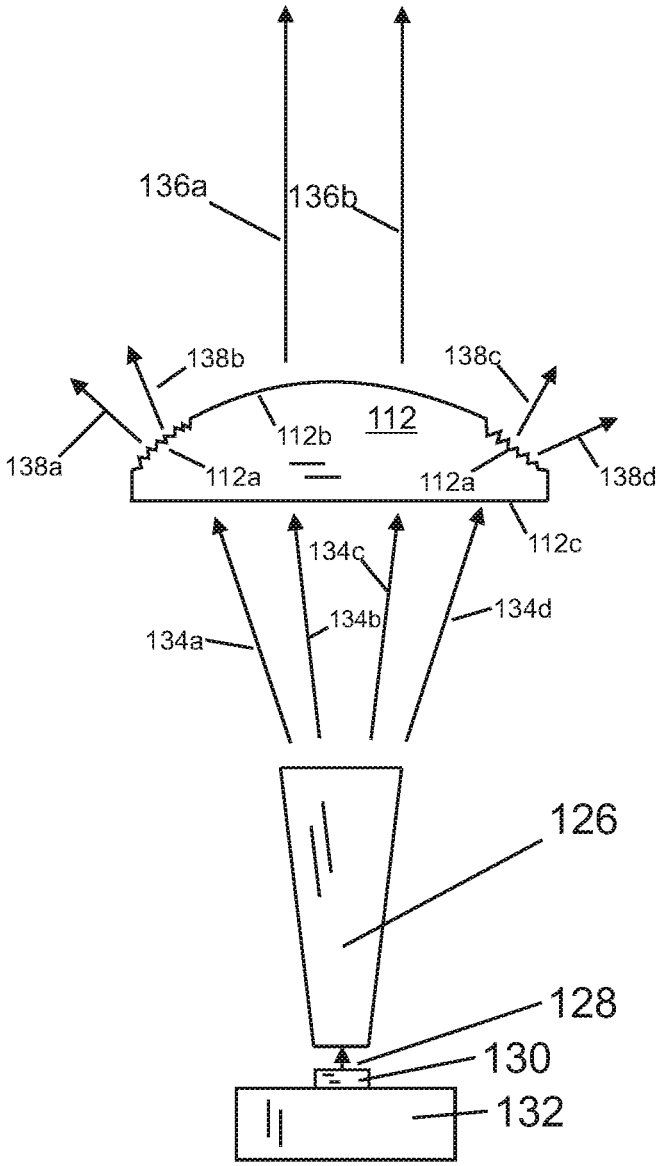
FIG. 6 shows a single multicolor light source, light pipe and a lens of the invention.

FIG. 6 shows a side view of the lens 112 of FIG. 5 and a light source 132 that may be a multicolor light source comprising Red, Green, Blue and White light emitting diodes. An emission lens 130 emits the multiwavelength light to the light pipe 126 in the direction of arrow 128. The use of the light pipe 126 helps to blend or homogenize the multicolor light from the multicolor light sources 132. The light pipe 126 in turn emits homogenized light in the direction of the first polished surface or polished surface 112*c* of the lens 112, such as in directions or arrows 134*a*, 134*b*, 134*c*, and 134*d*. The focused light shown by rays 136*a* and 136*b* passes through the central portion of the lens 112, out the polished surface 112*b* in the direction of focused output rays 136*a* and 136*b*. The perimeter rays 134*a*-134*d* emitted by the light pipe 126 pass through the polished bottom surface 112*c* and then through the diffuse perimeter areas 112*a* (to the left and right of FIG. 6) of the lens 112. The diffuse area 112*a* of the lens 112 scatters the exiting light rays as shown by rays 138*a*, 138*b*, 138*c*, and 138*d*.

Because some or a portion of the light rays 134*a-d* are scattered as they pass though the diffuse perimeter area 112*a* of the lens 112, the viewed surface intensity of the perimeter area 112*a* of the lens 112 is much higher than the light passing though the polished surface 112*b*. The diffuse perimeters 112*a*-124*a* of corresponding lenses 112, 114, 116, 118, 120, 122, and 124 provide a pleasing glowing outline or aureole to the plurality of lenses 112-124 of the theatrical light of at least one embodiment of the present invention. Because the preferred diffuse areas of the lenses 112-124 are the outer perimeters there is relatively low transmission loss due to the light being scattered from the diffuse areas 112*a*-124*a*. In order to keep the efficiency of the lenses 112-124 high it is preferred that the diffuse perimeter area, such as one of 112*a*-124*a*, be five to fifteen percent of the total surface area of the corresponding lens of 112-124. The light sources 132 may be light emitting diodes or the light sources 132 may be solid state laser light sources. While the outer surfaces or perimeter areas 112*a*-124*a* (second surface) of the corresponding lenses 112-124 have been made diffuse it is also possible to produce a lens with the first surface, such as the bottom surface 112*c* of lens 112 having a diffuse perimeter. It is preferred the diffuse perimeter of the lenses 112, 114, 116, 118, 120, 122, and 124, be completely to the outside, whether on the perimeter as for 112*a* or in the area of the top surface 112*b* or in the area of the bottom surface 112*c*.

In at least one embodiment, the inner portion (corresponding one of inner portions 112*b*-124*b*) of each of the plurality of lenses 112-124 is substantially more polished, and substantially less diffuse that the corresponding perimeter portion (corresponding one of perimeter portions 112*a*-124*a*) of each of the plurality of lenses 112-124 so that light is transmitted in a substantially uniform direction, such as directions 136*a*-*b* through the inner portion (corresponding one of inner portions 112*b*-124*b*) of each of the plurality of lenses 112-124 and light is transmitted in a scattered manner (as shown by 138*a*-138*d* through perimeter 112*a* for lens 112) through the perimeter portion of each of the plurality of lenses 112-124.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. A theatre lighting apparatus comprising:
a base housing;
and a lamp housing;
wherein the lamp housing is remotely positioned in relation to the base housing by a motor;
wherein the lamp housing is comprised of a plurality of light sources and a plurality of lenses;
wherein each of the plurality of lenses has a first surface and a second surface;
wherein each second surface of each of the plurality of lenses has an inner portion and a perimeter portion;
wherein the inner portion of each of the plurality of lenses is substantially more polished, and substantially less diffuse that the corresponding perimeter portion of each of the plurality of lenses so that light is transmitted in a substantially uniform direction through the inner portion of each of the plurality of lenses and light is transmitted in a scattered manner through the perimeter portion of each of the plurality of lenses.

2. The theater lighting apparatus of claim 1 wherein
at least one of the plurality of lenses is octagonally shaped.

3. The theatre lighting apparatus of claim 1 wherein
each the diffuse perimeter portions of each of the plurality of lenses has a surface area which is between five and fifteen percent of the overall surface area of the corresponding lens of each of the plurality of lenses.

4. The theatre lighting apparatus of claim 1 wherein
each of the plurality of light sources is comprised of a light emitting diode.

5. The theatre lighting apparatus of claim 1 wherein
each of the plurality of light sources is a laser diode.

6. The theatre lighting apparatus of claim 1 wherein
each of the plurality of light sources is comprised of a red, blue and green LED.

7. The theatre lighting apparatus of claim 1 wherein
each of the plurality of lenses is aspherical shaped.

8. A method comprising:
creating a plurality of aureoles on a plurality of lenses as part of a theatre lighting apparatus;
wherein the theatre lighting apparatus is comprised of:
a base housing;
and a lamp housing;
wherein the lamp housing is remotely positioned in relation to the base housing by a motor;
wherein the lamp housing is comprised of a plurality of light sources and the plurality of lenses;
wherein each of the plurality of lenses has a first surface and a second surface;
wherein each second surface of each of the plurality of lenses has an inner portion and a perimeter portion;
wherein the inner portion of each of the plurality of lenses is substantially more polished, and substantially less diffuse that the corresponding perimeter portion of each of the plurality of lenses so that light is transmitted in a substantially uniform direction through the inner portion of each of the plurality of lenses and light is transmitted in a scattered manner through the perimeter portion of each of the plurality of lenses.

9. The method of claim 8 wherein
at least one of the plurality of lenses is octagonally shaped.

10. The method of claim 8 wherein
each perimeter portion of each of the plurality of lenses has a surface area which is between five and fifteen percent of the overall surface area of the corresponding lens of each of the plurality of lenses.

11. The method of claim 8 wherein
each of the plurality of light sources is comprised of a light emitting diode.

12. The method of claim 8 wherein
each of the plurality of light sources is a laser diode.

13. The method of claim 8 wherein
each of the plurality of light sources is comprised of a red, blue and green LED.

14. The method of claim 8 wherein
each of the plurality of lenses is aspherical shaped.

* * * * *